US008557732B2

(12) United States Patent
Kobori et al.

(10) Patent No.: US 8,557,732 B2
(45) Date of Patent: Oct. 15, 2013

(54) COATING MATERIAL AND METHOD FOR PRODUCING THE SAME

(75) Inventors: Hideyuki Kobori, Numazu (JP); Shuji Hanai, Numazu (JP); Tomohito Shimizu, Numazu (JP); Yasuhide Takashita, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 767 days.

(21) Appl. No.: 12/035,889

(22) Filed: Feb. 22, 2008

(65) Prior Publication Data

US 2008/0206496 A1 Aug. 28, 2008

(30) Foreign Application Priority Data

Feb. 27, 2007 (JP) ..... 2007-047221

(51) Int. Cl.
*B41M 5/26* (2006.01)

(52) U.S. Cl.
USPC ..... 503/209

(58) Field of Classification Search
USPC ..... 503/207, 226, 209
See application file for complete search history.

(56) References Cited

U.S. PATENT DOCUMENTS

| | | | | |
|---|---|---|---|---|
| 4,758,547 | A * | 7/1988 | Itabashi et al. | 503/207 |
| 5,219,820 | A * | 6/1993 | Morohoshi et al. | 503/204 |
| 5,725,665 | A | 3/1998 | Yapel et al. | |
| 7,494,954 | B2 * | 2/2009 | Mito et al. | 503/200 |
| 7,635,661 | B2 * | 12/2009 | Iida et al. | 503/207 |
| 2003/0228439 | A1 | 12/2003 | Kawakami | |
| 2004/0126719 | A1 | 7/2004 | Geuens et al. | |
| 2005/0054527 | A1 | 3/2005 | Iwasaki et al. | |
| 2005/0170959 | A1 | 8/2005 | Iwasaki et al. | |
| 2008/0038475 | A1 | 2/2008 | Boschert et al. | |

FOREIGN PATENT DOCUMENTS

| | | | |
|---|---|---|---|
| CN | 1612812 | | 5/2005 |
| EP | 1367437 | A2 * | 12/2003 |
| EP | 1431059 | A1 | 6/2004 |
| EP | 1466752 | A1 * | 10/2004 |
| JP | 2003-182231 | | 7/2003 |
| JP | 2003-341229 | | 12/2003 |
| JP | 3579392 | | 7/2004 |
| WO | WO97/40947 | | 11/1997 |
| WO | WO03/049870 | A1 | 6/2003 |
| WO | WO2005/084958 | A1 | 9/2005 |
| WO | WO 2006070594 | A1 * | 7/2006 |

OTHER PUBLICATIONS

European search report in connection with a counterpart European patent application No. 08 10 1945.

(Continued)

*Primary Examiner* — Gerard Higgins
(74) *Attorney, Agent, or Firm* — Cooper & Dunham LLP

(57) ABSTRACT

A coating material capable of making a coating surface smoother, improving glossiness and being suitably used especially as a thermosensitive recording material, is provided, along with a method for producing the same. As a means for realizing the foregoing, there is provided a coating material produced by a multilayer simultaneous coating process, including: an outermost coating surface having moisture evaporation pores, wherein the moisture evaporation pores are 1.5 μm or less in average diameter. And there is a method for producing the coating material, including: simultaneously depositing two or more types of coating solutions over a continuously running web, and drying the coating solutions, wherein a coating solution which constitutes a coating other than an outermost coating surface is formed of a dispersion solution, and dispersed particles contained in the dispersion solution are 1 μm or less in average diameter.

10 Claims, 1 Drawing Sheet

(56) References Cited

OTHER PUBLICATIONS

Jun. 26, 2008 search report in connection with a counterpart European patent application No. 08 10 1945.

Jun. 2, 2010 Chinese official action (and English translation thereof) in connection with counterpart Chinese patent application.

Japanese official action dated Mar. 27, 2012 in a corresponding Japanese patent application.

* cited by examiner

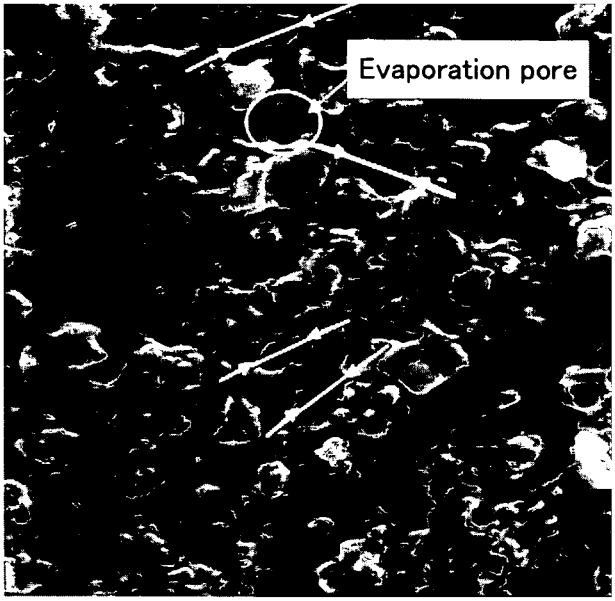
Evaporation pore

COATING MATERIAL AND METHOD FOR PRODUCING THE SAME

BACKGROUND OF THE INVENTION

1. Technical Field

This disclosure relates to a coating material produced by a multilayer simultaneous coating process and a method for producing the same, particularly to a coating material which is useful for a thermosensitive recording material and a method for producing the same.

2. Description of the Related Art

Conventionally, when a thermosensitive recording material is produced, an under layer (for heat insulation, sealing of the web, etc.), a thermosensitive recording layer and a protective layer are applied over a web one by one, by blade coating, wire bar coating, rod bar coating or the like.

Today, however, as often used in producing photographic photosensitive materials and the like such as photographic films, multilayer simultaneous coating based upon a slide curtain coating process is becoming popular, in which coating solutions having different functions are discharged from respective slits and deposited over a sliding surface, then the deposited coating solutions are made to fall freely and hit a continuously running web, and a coating film is thus formed.

However, this slide curtain coating process presents such a problem that in comparison with the conventional process of applying layers one by one, moisture evaporation pores created in a coating surface when dried are large in size, and thus the coating surface is uneven. FIG. 1 shows evaporation pores in a coating surface produced by a multilayer simultaneous coating process using a slide curtain coating apparatus. As shown in FIG. 1, large evaporation pores were observed.

The mechanism of the creation of moisture evaporation pores cannot be specified; nevertheless, as far as the conventional process of applying layers one by one is concerned, moisture evaporates from a surface when dried, a solid content is concentrated from the coating surface side, a dissolved resin on the coating web side also moves to the surface side when the moisture moves from the web side to the surface side, a resin film is thusly formed on the coating surface side; moreover, the evaporation rate is high, so that the time spent in forming a film structure when dried is short, and flocculation of dispersed particles hardly takes place in the coating. Therefore, the coating surface is smoother. Meanwhile, as for a product produced by a multilayer simultaneous coating process, a dispersion solution is used for a deposited layer other than a top layer. Accordingly, when a coating surface is created in the form of a film as it is dried, a dispersion solution layer constituting an under layer is still liquid and is therefore gradually dried. Thus, the drying takes place slowly, and contraction of the film also takes place slowly; therefore, the time spent in forming a film structure when dried is long, flocculation occurs amongst dispersed particles in the coating, and moisture is unevenly present in the dispersion solution layer. Accordingly, it is inferred that the following is possible: at a late stage of the drying, when moisture in the dispersion solution layer evaporates, evaporation pores become large in size at a place where there is a great deal of moisture; meanwhile, empty spaces are created by the evaporation, and adjacent particles move so as to fill the empty spaces, thereby making the coating surface uneven. Consequently, regarding the product produced by a multilayer simultaneous coating process, projections and recesses stemming from evaporation pores are created on the coating top layer surface when dried, thereby worsening the glossiness of a thermosensitive recording material product. Hence, faulty products may be produced by this process, which is problematic.

Meanwhile, there is a method disclosed in which an attempt to further prevent the blurring of printed letters/characters caused by color-developing unevenness at a printed portion is made by setting the center line average roughness ($R_{a75}$) of a thermosensitive recording surface at 0.5 μm to 2.0 μm, when a thermosensitive recording material is produced by a curtain coating process (refer to Japanese Patent (JP-B) No. 3579392).

However, as to improvement in the glossiness of a coating, which is an object of the present invention, there is such a problem that a desired effect cannot be obtained by merely adjusting the center line average roughness. In addition, the disclosed literature does not disclose how the center line average roughness ($R_{a75}$) of the thermosensitive recording surface is controlled. Moreover, it does not disclose the effects which the center line average roughness ($R_{a75}$) has on the glossiness of the thermosensitive recording material.

BRIEF SUMMARY

In an aspect of this disclosure, there is provided a coating material capable of making smoother a coating surface produced by a multilayer simultaneous coating process, improving glossiness and being suitably used especially as a thermosensitive recording material, and a method for producing the same.

In another aspect of this disclosure, there is provided a thermosensitive recording coating material produced by a multilayer simultaneous coating process, (1) including: an outermost coating surface having moisture evaporation pores, wherein the moisture evaporation pores are 1.5 μm or less in average diameter has superior coating glossiness. Further, (2) the thermosensitive recording coating material according to (1), wherein the number of the moisture evaporation pores which are 1.5 μm or greater in diameter is 20 or less per 2,500 $\mu m^2$ has greater glossiness. Further, (3) the thermosensitive recording coating material according to any one of (1) and (2), wherein the outermost coating surface has a surface roughness Rp value of 7 μm or less has even greater glossiness. (4) The thermosensitive recording coating material according to any one of (1) to (3), wherein the multilayer simultaneous coating process uses a curtain coating apparatus. (5) In particular, use of a slide curtain coating apparatus is favorable.

In another aspect of this disclosure, there is provided (6) a method for producing a thermosensitive recording coating material by a multilayer simultaneous coating process, including: simultaneously depositing two or more types of coating solutions over a continuously running web, and drying the coating solutions, wherein a coating solution which constitutes a coating other than an outermost coating surface is formed of a dispersion solution, dispersed particles contained in the dispersion solution are 1 μm or less in average diameter, and moisture evaporation pores in the outermost coating surface of the thermosensitive recording coating material obtained are 1.5 μm or less in average diameter. (7) The method according to (6), wherein the dispersion solution contains inorganic particles. (8) It is desirable that the inorganic particles occupy 30% by mass to 50% by mass of all particles contained in the dispersion solution. (9) Also, it is desirable that resin occupy 8% by mass to 30% by mass of the total solid content of the dispersion solution according to any one of (6) to (8).

In another aspect of this disclosure, there is provided (10) a method for producing a thermosensitive recording coating material by a multilayer simultaneous coating process, including: simultaneously depositing two or more types of coating solutions over a continuously running web, and drying the coating solutions, wherein besides an outermost coating surface, a coating (1) constructed of a coating solution formed of a dispersion solution and a coating (2) constructed of a coating solution containing a resin of 500 or greater in polymerization degree, which serves as an over layer adjacent or not adjacent to the coating (1), are provided, and moisture evaporation pores in the outermost coating surface of the thermosensitive recording coating material obtained are 1.5 μm or less in average diameter. (11) The method according to (10), wherein the drying is conducted after the resin contained in the coating (2) has been cured. (12) The method according to (11), wherein the resin contained in the coating (2) is cured by means of gelation. (13) The method according to (11), wherein the resin contained in the coating (2) is cured such that a UV-curable resin is used for the resin and the UV-curable resin is irradiated with an ultraviolet ray. (14) The method according to (11), wherein the resin contained in the coating (2) is cured such that an electron beam curable resin is used for the resin and the electron beam curable resin is irradiated with an electron beam. (15) The method according to (10), wherein the coating (2) is a coating constructed of a coating solution containing an acrylic resin, a urethane resin or an SBR resin.

BRIEF DESCRIPTION OF THE SEVERAL VIEWS OF THE DRAWING

FIG. 1 shows moisture evaporation pores in a coating surface produced by an unimproved slide curtain multilayer simultaneous coating process.

DETAILED DESCRIPTION OF THE INVENTION

The following explains the present invention in further detail.

<Moisture Evaporation Pores in Outermost Coating Surface of Coating Material>

A coating material of the present invention is a coating material produced by a multilayer simultaneous coating process, including: an outermost coating surface having moisture evaporation pores, wherein the moisture evaporation pores are 1.5 μm or less in average diameter. When the moisture evaporation pores are greater than 1.5 μm in average diameter, the glossiness required for the present invention cannot be obtained. It is more desirable that the moisture evaporation pores be 1.0 μm or less in average diameter.

As shown in FIG. 1, the moisture evaporation pores in the present invention denote roughly circular pores formed in the depthwise direction created when moisture evaporates from a coating film surface as coating solutions are dried, and the object of the present invention is achieved by determining the size of the pores. Therefore, regardless of the size of the moisture evaporation pores, the glossiness in the present invention cannot be controlled by means of a value, such as the value of the surface roughness, calculated by averaging the sizes of all projections and recesses (including projections and recesses created by a surface filler, for example) on a surface. Also, affected only by the projections and recesses on the surface regardless of the size of the moisture evaporation pores, the smoothness cannot represent the glossiness in the present invention either.

As to how the moisture evaporation pores are measured for diameter, the coating surface is observed using a scanning electron microscope (SEM), the lengths of lengthwise sides of all roughly circular pores (of which there are various shapes) formed in the depthwise direction inside an area of 25 μm×25 μm are measured with a scale as shown in FIG. 1, and their average value is calculated.

The coating material of the present invention is capable of making the coating surface even smoother when the number of moisture evaporation pores which are 1.5 μm or greater in diameter is 20 or less per 2,500 $\mu m^2$, and thus improving the glossiness of the coating surface. It is more desirable that the number be 10 or less.

Also, the coating material of the present invention is capable of further improving the glossiness of the coating surface when the outermost coating surface has a surface roughness Rp value of 7 μm or less.

The surface roughness Rp value in the present invention denotes a value calculated in accordance with JIS B0652.

<Multilayer Simultaneous Coating Process>

Although not particularly limited, it is desirable that the multilayer simultaneous coating process in the present invention employ a known curtain coating process using a curtain coating apparatus provided with a discharge unit that discharges two or more types of coating solutions from respective slits, in which the coating solutions are discharged from the respective slits and deposited, then the deposited coating solutions are made to fall freely onto a continuously running web and thus applied. What is more favorable is a known slide curtain coating process using a slide curtain coating apparatus provided with a discharge unit that discharges two or more types of coating solutions from respective slits and with a sliding surface where the discharged coating solutions flow, in which the coating solutions are discharged from the respective slits and deposited over the sliding surface, then the deposited coating solutions are made to fall freely onto a continuously running web and thus applied.

On this occasion, as means of reducing the moisture evaporation pores in the outermost coating surface to 1.5 μm or less in average diameter, the following several methods can be mentioned. It should be noted that the following methods are applicable not only to the above-mentioned curtain coating processes but also to other multilayer simultaneous coating processes.

<Coating Solution which Constitutes Coating Other than Outermost Coating Surface>

(a) A coating solution which constitutes a coating other than the outermost coating surface is formed of a dispersion solution, and dispersed particles contained in the dispersion solution are made equal to or less than 1 μm in average diameter.

Thus, when moisture of a coating film produced by a multilayer simultaneous coating process evaporates, the extent of the uneven presence of moisture in the film caused by flocculation of the dispersed particles at the time of contraction of the film becomes small, and evaporation pores created become small in size. Meanwhile, empty spaces are created by the evaporation, and adjacent particles move so as to fill the empty spaces; however, since the particles are small in size, the number of the particles in a layer (dispersed particle layer) formed by the dispersion solution becomes large, and thus effects on the creation of projections and recesses on the coating surface are lessened; therefore, the coating surface can be made smoother, and the glossiness of the coating surface can be improved.

(b) A coating solution which constitutes a coating other than the outermost coating surface is formed of a dispersion solution, and the dispersion solution contains inorganic particles.

Thus, since dispersed particles are hydrophilic, they are compatible with a water-soluble resin; hence, when moisture of a coating film produced by a multilayer simultaneous coating process evaporates, flocculation amongst the dispersed particles hardly takes place at the time of contraction of the dispersed particle layer, the extent of the uneven presence of moisture can be made small, and evaporation pores can be made small in size. Therefore, the coating surface can be made smoother, and the glossiness of the coating surface can be improved.

This effect is further improved when the inorganic particles are made to occupy 30% by mass to 50% by mass of all particles contained in the dispersion solution. When they occupy less than 30% by mass, the coating surface becomes uneven, and the glossiness of the coating surface becomes poor. When they occupy more than 50% by mass, the color-developing density of a thermosensitive recording material decreases.

Examples of the inorganic particles herein stated include, but not limited to, particles formed of calcium carbonate, calcium oxide, zinc oxide, titanium oxide, magnesium carbonate, magnesium oxide, silica, aluminum hydroxide, barium sulfate, kaolin, lithopone and pyrophyllite.

(c) A coating solution which constitutes a coating other than the outermost coating surface is formed of a dispersion solution, and resin is preferably made to occupy 8% by mass to 30% by mass of the total solid content of the dispersion solution.

Thus, when moisture of a coating film produced by a multilayer simultaneous coating process evaporates, flocculation amongst dispersed particles hardly takes place at the time of contraction of the dispersed particle layer, the extent of the uneven presence of moisture can be made small, and evaporation pores can be made small in size; therefore, the coating surface can be made smoother, and the glossiness of the coating surface can be improved. When resin occupies less than 8% by mass, the coating surface becomes uneven, and the glossiness of the coating surface becomes poor. When it occupies more than 30% by mass, the color-developing density of a thermosensitive recording material decreases.

<Intermediate Coating Layer>

(d) Besides the outermost coating surface, there are provided: a coating (1) constructed of a coating solution formed of a dispersion solution, and a coating (2) constructed of a coating solution containing a resin of 500 or greater in polymerization degree, which serves as an over layer adjacent or not adjacent to the coating (1).

Thus, the mechanical strength of an over layer surface film becomes greater when dry; when moisture of a coating film produced by a multilayer simultaneous coating process evaporates, empty spaces are created by the evaporation of moisture of a dispersed particle layer below, and adjacent particles nearly move so as to fill the empty spaces; however, since it is difficult for the over layer surface film to move, the coating surface can be made smoother, and the glossiness of the coating surface can be improved. Examples of the resin herein stated include, but not limited to, polyvinyl alcohol, cellulose derivatives such as methoxy cellulose, hydroxyethyl cellulose, carboxymethyl cellulose, methyl cellulose and ethyl cellulose, sodium polyacrylate, polyvinylpyrrolidone, acrylamide-acrylic acid ester copolymer, acrylamide-acrylic acid ester-methacrylic acid ternary copolymer, styrene-maleic anhydride copolymer alkaline salt, isobutylene-maleic anhydride copolymer alkaline salt, polyacrylamide and sodium alginate. Also, these may be used independently or in combination.

(e) Besides the outermost coating surface, there are provided: a coating (1) constructed of a coating solution formed of a dispersion solution, and a coating (2) constructed of a coating solution containing a resin, which serves as an over layer adjacent or not adjacent to the coating (1). And the coating solutions are dried after the resin contained in the coating (2) has been cured.

Thus, the mechanical strength of an over layer surface film becomes greater when dry; when moisture of a coating film produced by a multilayer simultaneous coating process evaporates, empty spaces are created by the evaporation of moisture of a dispersed particle layer below, and adjacent particles nearly move so as to fill the empty spaces; however, since it is difficult for the over layer surface film to move, the coating surface can be made smoother, and the glossiness of the coating surface can be improved.

The resin can be cured by means of gelation, for example.

Examples of the resin include substances such as gelatin that are gelated by cooling, and substances such as starch and dogtooth violet starch that are gelated by heating.

As another method for curing the resin, there is a method in which a UV-curable resin is used for the resin and the UV-curable resin is irradiated with an ultraviolet ray, for example.

The UV-curable resin is composed of appropriate proportions of a photopolymerizable prepolymer or a photopolymerizable monomer and a photopolymerization initiator, with the addition of a photopolymerization accelerator according to necessity. Examples of the photopolymerizable monomer include the ones mentioned as examples of the electron beam curable resin below. Examples of the photopolymerizable prepolymer include polyester acrylate, polyurethane acrylate, epoxy acrylate, polyether acrylate, oligoacrylate, alkyd acrylate and polyol acrylate.

Examples of the photopolymerization initiator are broadly classified into radical reaction type photopolymerization initiators and ionic reaction type photopolymerization initiators, and further, the radical reaction type photopolymerization initiators are classified into photofragmentation-type photopolymerization initiators and hydrogen abstraction type photopolymerization initiators. Specifically, photopolymerization initiators similar to the ones mentioned in Japanese Patent Application Laid-Open (JP-A) No. 07-172072 can be used. These photopolymerization initiators are used independently or in combination. The added amount thereof is preferably 0.005 parts by mass to 1.0 part by mass per 1 part by mass of the photopolymerizable prepolymer or of the photopolymerizable monomer, more preferably 0.01 parts by mass to 0.5 parts by mass.

Examples of the photopolymerization accelerator include aromatic tertiary amines and aliphatic amines, which have the effect of increasing the curing rate of hydrogen abstraction type photopolymerization initiators such as benzophenone-based photopolymerization initiators and thioxanthone-based photopolymerization initiators. Specific examples thereof include p-dimethylamino benzoic acid isoamylester and p-dimethylamino benzoic acid ethylester. These photopolymerization accelerators are used independently or in combination. The added amount thereof is preferably 0.1 parts by mass to 5 parts by mass with respect to 1 part by mass of the photopolymerization initiator, more preferably 0.3 parts by mass to 3 parts by mass.

As yet another method for curing the resin, there is a method in which an electron beam curable resin is used for the resin and the electron beam curable resin is irradiated with an electron beam.

The electron beam curable resin is selected from functional monomers and oligomers, and the functional monomers and oligomers can be used independently or in combination. Examples of the functional monomers include monofunctional and multifunctional monomers such as acrylates, methacrylates, vinyl esters, styrene derivatives and allyl compounds. Examples of the oligomers include urethane acrylates, epoxy acrylates, polyester acrylates, vinyls and unsaturated polyesters. As nonfunctional/functional monomers, specifically, monomers similar to the ones mentioned in JP-A No. 07-172072 can be used. It should, however, be noted that the nonfunctional/functional monomers are not strictly limited.

(f) Besides the outermost coating surface, there are provided: a coating (1) constructed of a coating solution formed of a dispersion solution, and a coating (2) constructed of a coating solution containing an acrylic resin, a urethane resin or an SBR resin, which serves as an over layer adjacent or not adjacent to the coating (1).

Thus, the mechanical strength of an over layer surface film becomes greater when dry; when moisture of a coating film produced by a multilayer simultaneous coating process evaporates, empty spaces are created by the evaporation of moisture of a dispersed particle layer below, and adjacent particles nearly move so as to fill the empty spaces; however, since it is difficult for the over layer surface film to move, the coating surface can be made smoother, and the glossiness of the coating surface can be improved.

The acrylic resin herein stated denotes a polymer of acrylic acid and a derivative thereof, to which a polymer and a copolymer of acrylic acid and an ester derivative thereof, acrylamide, acrylonitrile, methacrylic acid and an ester derivative thereof are applicable. Examples thereof include, but not particularly limited to, acrylic acid ester polymer, methacrylic acid ester polymer, styrene/acrylic acid ester copolymer, styrene/methacrylic acid ester copolymer, acrylamide/acrylic acid ester copolymer, acrylamide/methacrylic acid ester copolymer, acrylonitrile/acrylic acid ester copolymer and acrylonitrile/methacrylic acid ester copolymer.

Examples of the urethane resin include, but not limited to, polyester polyurethane, polyether polyurethane, polyether polyester polyurethane, polycarbonate polyurethane, polyester polycarbonate polyurethane and polycaprolactone polyurethane.

According to the present invention's coating material and method for producing the same, it is possible to obtain a thermosensitive recording material which has a smoother surface and is superior in glossiness. In the above-mentioned form, when the thermosensitive recording material is a thermosensitive recording material in which a thermosensitive recording layer, a barrier layer and a protective layer are placed over a web, the top layer coating is the protective layer, the coating (1) constructed of a coating solution formed of a dispersion solution is, for example, the thermosensitive recording layer, and the coating (2) serving as an over layer adjacent or not adjacent to the coating (1) is, for example, the barrier layer. In the present invention, known materials can be suitably used for the components of the thermosensitive recording material.

The coating solution constituting the coating (1) preferably has a viscosity of 10 mPa·s to 2,000 mPa·s and a static surface tension of 20 mN/m to 60 mN/m at 25° C., and the coating solution constituting the coating (2) preferably has a viscosity of 10 mPa·s to 3,000 mPa·s and a static surface tension of 10 mN/m to 60 mN/m at 25° C. It should, however, be noted that the coating solutions may have different viscosities and static surface tensions.

EXAMPLES

The following further explains the present invention by means of examples and comparative examples; however, the present invention is not restricted to these examples. Note that the term "part" in the examples is based upon mass.

Example 1

A slide curtain coating apparatus was used, and the discharge amounts of coating solutions to be discharged from respective slits were adjusted as follows.

The following thermosensitive recording layer coating solution: 1,300 g/min,

The following barrier layer coating solution: 1,400 g/min,

The following protective layer coating solution: 1,200 g/min.

A thermosensitive recording layer coating solution, a barrier layer coating solution and a protective layer coating solution were deposited in this order over a web (which is a product made by coating a surface of paper with the following under layer at 3.5 g/m$^2$ under dry conditions) in accordance with a slide curtain coating process. The coating rate and the coating width were set at 400 m/min and 250 mm respectively, the coating solutions were dried by means of hot-air drying at 150° C., and a coating sample was thus produced. Then the average diameter of moisture evaporation pores in the top layer coating (protective layer) surface of the coating sample was measured by observation with a scanning electron microscope. Also, the number of moisture evaporation pores in an area of 50 μm×50 μm was measured. Further, the surface roughness Rp value (maximum apical height) of the outermost coating surface was measured with TOPOGRAPH produced by Toyo Seiki Seisaku-Sho, Ltd. As for measurement conditions, the pressure was 10.4 kg/cm$^2$ and the time was 50 ms. Then a UV ink (NEW Z OP VARNISH produced by Dainippon Ink And Chemicals, Incorporated) was printed on a surface of the coating sample by an RI tester (ink gauge 10 graduations (1 ml), 1,000 r/min), and the glossiness thereof was measured at an angle of 75° by a glossmeter (VG-2PD produced by Nippon Denshoku Industries Co., Ltd.). The measurement results are shown in Table 1. Thermosensitive recording layer coating solution: 150 mPa·s in viscosity, 38 mN/m in static surface tension at 25° C. (measured by FACE AUTOMATIC SURFACE TENSIOMETER CBVP-A3 produced by Kyowa Interface Science Co., Ltd.) and 0.85 μm in average particle diameter (measured at a refractive index of 1.7 by LA-920 produced by HORIBA, Ltd.)

| | |
|---|---|
| 3-dibutylamino-6-methyl-7-anilinofluoran | 4 parts |
| 4-isopropoxy-4'-hydroxydiphenylsulfone | 12 parts |
| silica | 6 parts |
| 10% aqueous solution of polyvinyl alcohol | 16 parts |
| water | 41 parts |
| Barrier layer coating solution: 200 mPa · s in viscosity and 35 mN/m in static surface tension at 25° C. | |
| polyvinyl alcohol (300 in polymerization degree) | 70 parts |
| surfactant | 1 part |
| water | 930 parts |
| Protective layer coating solution: 250 mPa · s in viscosity and 31 mN/m in static surface tension at 25° C. | |
| itaconic acid-modified polyvinyl alcohol | 70 parts |
| aluminum hydroxide | 100 parts |
| silica | 5 parts |
| surfactant | 1 part |
| water | 704 parts |

-continued

| Under layer composition | |
|---|---|
| nonexpandable plastic fine hollow particles (90% in hollow ratio and 3 μm in average diameter) | 55 parts |
| polyvinyl alcohol | 14 parts |
| styrene-butadiene copolymer latex | 2 parts |

Example 2

The average particle diameter of the thermosensitive recording layer coating solution of Example 1 was changed to 0.60 μm, then coating similar to that of Example 1 was conducted to produce a coating sample, and a similar evaluation of the coating sample was carried out. The results are shown in Table 1.

Example 3

All dispersed particles in the thermosensitive recording layer coating solution of Example 1 were replaced by silica that is an inorganic substance as shown below, the average particle diameter thereof was changed to 1.10 μm, then coating similar to that of Example 1 was conducted to produce a coating sample, and a similar evaluation of the coating sample was carried out. The results are shown in Table 1.

Thermosensitive recording layer coating solution: 145 mPa·s in viscosity, 37 mN/m in static surface tension and 1.10 μm in average particle diameter

| | |
|---|---|
| silica | 22 parts |
| 10% aqueous solution of polyvinyl alcohol | 16 parts |
| water | 41 parts |

Example 4

Inorganic particles in the thermosensitive recording layer coating solution of Example 1 were made to occupy 33% by mass of all particles contained in a dispersion solution as shown below, the average particle diameter thereof was changed to 1.10 μm, then coating similar to that of Example 1 was conducted to produce a coating sample, and a similar evaluation of the coating sample was carried out. The results are shown in Table 1.

Thermosensitive recording layer coating solution: 150 mPa·s in viscosity, 38 mN/m in static surface tension and 1.10 μm in average particle diameter

| | |
|---|---|
| 3-dibutylamino-6-methyl-7-anilinofluoran | 4 parts |
| 4-isopropoxy-4'-hydroxydiphenylsulfone | 12 parts |
| silica | 8 parts |
| 10% aqueous solution of polyvinyl alcohol | 16 parts |
| water | 41 parts |

Example 5

In the thermosensitive recording layer coating solution of Example 1, resin was made to occupy 8.3% by mass of the total solid content, the average particle diameter thereof was changed to 1.10 μm, then coating similar to that of Example 1 was conducted to produce a coating sample, and a similar evaluation of the coating sample was carried out. The results are shown in Table 1.

Thermosensitive recording layer coating solution: 155 mPa·s in viscosity, 38 mN/m in static surface tension and 1.10 μm in average particle diameter

| | |
|---|---|
| 3-dibutylamino-6-methyl-7-anilinofluoran | 4 parts |
| 4-isopropoxy-4'-hydroxydiphenylsulfone | 12 parts |
| silica | 6 parts |
| 10% aqueous solution of polyvinyl alcohol | 20 parts |
| water | 41 parts |

Example 6

In the thermosensitive recording layer coating solution of Example 1, resin was made to occupy 1.0% by mass of the total solid content, the average particle diameter thereof was changed to 1.10 μm, then coating similar to that of Example 1 was conducted to produce a coating sample, and a similar evaluation of the coating sample was carried out. The results are shown in Table 1.

Thermosensitive recording layer coating solution: 155 mPa·s in viscosity, 38 mN/m in static surface tension and 1.10 μm in average particle diameter

| | |
|---|---|
| 3-dibutylamino-6-methyl-7-anilinofluoran | 4 parts |
| 4-isopropoxy-4'-hydroxydiphenylsulfone | 12 parts |
| silica | 6 parts |
| 10% aqueous solution of polyvinyl alcohol | 25 parts |
| water | 41 parts |

Example 7

The average particle diameter of the thermosensitive recording layer coating solution of Example 1 was changed to 1.10 μm, the polymerization degree of polyvinyl alcohol resin in the barrier layer coating solution was changed to 500, then coating similar to that of Example 1 was conducted to produce a coating sample, and a similar evaluation of the coating sample was carried out. The results are shown in Table 1.

Example 8

The average particle diameter of the thermosensitive recording layer coating solution of Example 1 was changed to 1.10 μm, the polymerization degree of polyvinyl alcohol resin in the barrier layer coating solution was changed to 1,700, then coating similar to that of Example 1 was conducted to produce a coating sample, and a similar evaluation of the coating sample was carried out. The results are shown in Table 1.

Example 9

The average particle diameter of the thermosensitive recording layer coating solution of Example 1 was changed to 1.10 μm, the polymerization degree of polyvinyl alcohol resin in the barrier layer coating solution was changed to 2,400, then coating similar to that of Example 1 was conducted to produce a coating sample, and a similar evaluation of the coating sample was carried out. The results are shown in Table 1.

Example 10

The average particle diameter of the thermosensitive recording layer coating solution of Example 1 was changed to 1.10 μm, the resin in the barrier layer coating solution was changed to gelatin, slide curtain coating was conducted similarly to that of Example 1; subsequently, the coating solutions were cooled from a back surface (flow of water at a roll surface temperature of 5° C. for 30 sec), then drying similar to that of Example 1 was conducted to produce a coating sample, and a similar evaluation of the coating sample was carried out. The results are shown in Table 1.

Example 11

The average particle diameter of the thermosensitive recording layer coating solution of Example 1 was changed to 1.10 μm, the resin in the barrier layer coating solution was changed to an acrylic resin (JONCRYL 52 produced by Johnson Polymer), then coating similar to that of Example 1 was conducted to produce a coating sample, and a similar evaluation of the coating sample was carried out. The results are shown in Table 1.

Example 12

The average particle diameter of the thermosensitive recording layer coating solution of Example 1 was changed to 1.10 μm, the resin in the barrier layer coating solution was changed to an acrylic resin (JONCRYL 537 produced by Johnson Polymer), then coating similar to that of Example 1 was conducted to produce a coating sample, and a similar evaluation of the coating sample was carried out. The results are shown in Table 1.

Example 13

The average particle diameter of the thermosensitive recording layer coating solution of Example 1 was changed to 1.10 μm, the resin in the barrier layer coating solution was changed to a urethane resin (Hydran HW930 produced by Dainippon Ink And Chemicals, Incorporated), then coating similar to that of Example 1 was conducted to produce a coating sample, and a similar evaluation of the coating sample was carried out. The results are shown in Table 1.

Example 14

The average particle diameter of the thermosensitive recording layer coating solution of Example 1 was changed to 1.10 μm, the resin in the barrier layer coating solution was changed to styrene-butadiene copolymer latex, then coating similar to that of Example 1 was conducted to produce a coating sample, and a similar evaluation of the coating sample was carried out. The results are shown in Table 1.

Comparative Example 1

The average particle diameter of the thermosensitive recording layer coating solution of Example 1 was changed to 1.10 μm, then coating similar to that of Example 1 was conducted to produce a coating sample, and a similar evaluation of the coating sample was carried out. The results are shown in Table 1.

Example 15

The average particle diameter of the thermosensitive recording layer coating solution of Example 1 was changed to 1.10 μm, the barrier layer coating solution was changed to a mixture of a self-emulsification type aqueous emulsion resin (BEAMSET EM-90 produced by Arakawa Chemical Industries, Ltd.) and a photopolymerization initiator (DAROCURE 1173 produced by Ciba Specialty Chemicals) as shown below, the discharge amount of the barrier layer coating solution was changed to 700 g/min, and curtain coating was conducted. Subsequently, the barrier layer was cured by a UV irradiation apparatus (80 W at a rate of 10 m/min), then drying similar to that of Example 1 was conducted to produce a coating sample, and a similar evaluation of the coating sample was carried out. The results are shown in Table 1.

Barrier layer coating solution: 150 mPa·s in viscosity and 35 mN/m in static surface tension at 25° C.

| | |
|---|---|
| BEAMSET EM-90 | 133 parts |
| DAROCURE 1173 | 6 parts |
| surfactant | 1 part |
| water | 860 parts |

Example 16

The average particle diameter of the thermosensitive recording layer coating solution of Example 1 was changed to 1.10 μm, the barrier layer coating solution was changed to a self-emulsification type aqueous emulsion resin (BEAMSET EM-90 produced by Arakawa Chemical Industries, Ltd.) as shown below, the discharge amount of the barrier layer coating solution was changed to 700 g/min, curtain coating was thusly conducted; subsequently, the barrier layer was cured by an electron beam irradiation apparatus (175 keV, 0.7 mA, at a rate of 10 m/min), then drying similar to that of Example 1 was conducted to produce a coating sample, and a similar evaluation of the coating sample was carried out. The results are shown in Table 1. Barrier layer coating solution: 150 mPa·s in viscosity and 35 mN/m in static surface tension at 25° C.

| | |
|---|---|
| BEAMSET EM-90 | 139 parts |
| surfactant | 1 part |
| water | 860 parts |

TABLE 1

| | Average diameter of moisture evaporation pores [μm] | Number of moisture evaporation pores which are 1.5 μm or greater in diameter [number] | Surface roughness Rp value [μm] | Glossiness [%] |
|---|---|---|---|---|
| Example 1 | 1.22 | 14 | 5.9 | 82.5 |
| Example 2 | 0.99 | 3 | 3.8 | 86.8 |
| Example 3 | 0.89 | 3 | 3.3 | 91.2 |
| Example 4 | 1.34 | 17 | 6.7 | 80.1 |
| Example 5 | 1.25 | 15 | 5.9 | 83.8 |
| Example 6 | 1.10 | 11 | 5.2 | 84.3 |
| Example 7 | 1.23 | 12 | 6.2 | 80.6 |
| Example 8 | 1.08 | 8 | 4.1 | 85.6 |
| Example 9 | 1.05 | 7 | 3.9 | 87.1 |
| Example 10 | 0.99 | 3 | 3.5 | 87.3 |
| Example 11 | 1.03 | 3 | 3.8 | 88.2 |
| Example 12 | 1.01 | 4 | 3.7 | 86.8 |
| Example 13 | 0.98 | 2 | 3.8 | 88.3 |
| Example 14 | 0.92 | 2 | 3.0 | 89.2 |
| Example 15 | 0.98 | 2 | 3.8 | 88.3 |
| Example 16 | 0.92 | 2 | 3.0 | 89.2 |
| Comparative Example 1 | 1.70 | 26 | 8.6 | 68.2 |

The average diameter of moisture evaporation pores and the number of moisture evaporation pores which are 1.5 μm or greater in diameter are based upon 2,500 $\mu m^2$ in surface area.

Judging from the results of Table 1, the samples produced in accordance with the production methods of Examples 1 to 16 could attain 80% or greater in glossiness and were therefore superior in glossiness to the sample of Comparative Example 1.

Since the present invention's coating material and method for producing the same are capable of making a coating surface smoother and improving glossiness, they can be suitably used in obtaining thermosensitive recording materials in particular.

What is claimed is:

1. A thermosensitive recording material produced by a multilayer simultaneous coating process which includes a step of simultaneously depositing two or more types of coating solutions over a continuously running web, the thermosensitive recording material comprising in the recited order:

a dried coating (1) as a thermosensitive recording layer, the dried coating (1) formed from a dispersion solution;

a dried coating (2) as an over layer adjacent to the dried coating (1), the dried coating (2) formed from a coating solution including a resin; and a protective layer having an outermost coating surface having moisture evaporation pores, wherein the moisture evaporation pores are 1.5 μm or less in average diameter, and wherein the coating solution for the dried coating (2) includes a urethane resin.

2. The thermosensitive recording material according to claim 1, wherein the number of the moisture evaporation pores which are 1.5 μm or greater in diameter is 20 or less per 2,500 $\mu m^2$.

3. The thermosensitive recording material according to claim 1, wherein the outermost coating surface has a surface roughness Rp value of 7 μm or less.

4. The thermosensitive recording material according to claim 1, wherein the multilayer simultaneous coating process is a process using a curtain coating apparatus provided with a discharge unit that discharges two or more types of coating solutions from respective slits, in which process the coating solutions are discharged from the respective slits and deposited over a sliding surface, then the deposited coating solutions are made to fall freely onto a continuously running web and thus applied.

5. The thermosensitive recording material according to claim 1, wherein the dispersion solution for the dried coating (1) includes inorganic particles occupying 30% by mass to 50% by mass of all particles contained in the dispersion solution.

6. The thermosensitive recording material according to claim 1, wherein resin occupies 8% by mass to 30% by mass of the total solid content of the dispersion solution for the dried coating (1).

7. The thermosensitive recording material according to claim 1, wherein the resin contained in the coating solution for the dried coating (2) has 500 or greater in polymerization degree.

8. The thermosensitive recording material according to claim 1, wherein the multilayer simultaneous coating process further includes a step of drying the dispersion solution for the dried coating (1), the coating solution for the dried coating (2) and a coating solution for the protective layer by means of hot air drying, thereby forming the moisture evaporation pores on the outer coating surface of the protective layer.

9. The thermosensitive recording material according to claim 8, wherein the hot air drying is performed at 150° C.

10. A thermosensitive recording material produced by a multilayer simultaneous coating process which includes a step of simultaneously depositing two or more types of coating solutions over a continuously running web, the thermosensitive recording material comprising in the recited order:

a dried coating (1) as a thermosensitive recording layer, the dried coating (1) formed from a dispersion solution;

a dried coating (2) as an over layer adjacent to the dried coating (1), the dried coating (2) formed from a coating solution consisting of a resin, a surfactant and water; and a protective layer having an outermost coating surface having moisture evaporation pores, wherein the moisture evaporation pores are 1.5 μm or less in average diameter, and wherein the coating solution for the dried coating (2) includes a urethane resin.

* * * * *